United States Patent [19]

Johnson, deceased et al.

[11] 4,165,666

[45] Aug. 28, 1979

[54] APPARATUS FOR SYNCHRONIZING ADVANCE OF WEB AND ROTATIONAL SPEED OF BUCKET OR LIKE METHOD

[75] Inventors: Arthur R. Johnson, deceased, late of Hartford, Conn.; Paul A. Hudon, administrator, West Hartford, Conn.

[73] Assignee: Preston Engravers, Inc., Windsor, Conn.

[21] Appl. No.: 834,521

[22] Filed: Sep. 19, 1977

[51] Int. Cl.[2] ..... B21D 43/04

[52] U.S. Cl. ..... 83/313; 83/328; 226/113

[58] Field of Search ..... 83/313, 328; 226/113, 226/114

[56] References Cited

U.S. PATENT DOCUMENTS

| | | | |
|---|---|---|---|
| 3,080,782 | 3/1963 | Socke | 83/313 |
| 3,084,841 | 4/1963 | Hata et al. | 226/113 |
| 3,156,150 | 11/1964 | Sarka | 83/313 X |
| 3,526,563 | 9/1970 | Schott, Jr. | 226/113 X |
| 3,743,567 | 7/1973 | Abler | 226/113 X |
| 3,861,260 | 1/1975 | Kesten | 83/328 |

*Primary Examiner*—J. M. Meister

[57] ABSTRACT

A tool assembly includes first and second means which define between them a work station at which they periodically engage and release a moving web of material to perform a work operation, such as die cutting, on the web. A reciprocating shuttle has a pair of guide rollers on it which respectively engage the web before and after the tool means to alternately increase and decrease the work station velocity of the web by alternately decreasing and increasing the web path distance between the shuttle and the work station. The frequency of tool means movement is adjustable to adjust the repeat between work operations on the web. The shuttle means are synchronized with the tool means so that the work station web velocity at the time the tool means contact the web is substantially equal to the tangential velocity of the tool means. The method of the invention calls for thus adjusting momentary work station web velocity to match the tangential velocity of the tool means while maintaining a constant average web velocity through the tool assembly.

12 Claims, 6 Drawing Figures

APPARATUS FOR SYNCHRONIZING ADVANCE OF WEB AND ROTATIONAL SPEED OF BUCKET OR LIKE METHOD

BACKGROUND OF THE INVENTION

The present invention pertains to tool assemblies adapted to perform a work operation on a web of moving material, and more particularly to tool assemblies of the type wherein a pair of opposed tool means are mounted for movement to and from each other to periodically engage and release a web of material to perform a work operation on it. Typically, such work operation is a punching operation in which the paired tool means are, respectively, a punch and a die. However, other work operations such as embossing and printing are equally well carried out by such tool assemblies.

U.S. Pat. No. 3,861,260 entitled Double Bucket Die Cutting Assembly issued to the assignee of the present application shows a tool assembly of this type wherein a die bucket and punch bucket are mounted eccentrically on mounting means carried by a frame to perform die punching on a web of material moving between them. The eccentric mounting on the rotating mounting means provides a periodic orbiting action which intermittently brings the two buckets into work performing contact with the web moving between them.

Web materials are fed to such tool assemblies, often at high speeds of web travel for repeated die punching or other work operations on the web. Obviously, the repeat distance between work operations on the web, e.g., between die punches, is determined by the frequency of the periodic movement of the tool means and the web velocity. If it is desired to be able to select different repeat distances it is necessary to either vary the frequency of tool movement or the average web speed or both. It is impractical to attempt to vary the average web speed. Generally, maximum web speed is desired for increased production. Further, web materials have a tendency to stretch and/or bunch up with changes in web velocity. Also, the tool assembly is usually one of a series of operations being carried out on the moving web and other pieces of equipment both upstream and downstream of the tool assembly require a constant overall web velocity so that proper registration between different operations may be maintained, etc.

Varying the frequency of periodic tool movement also causes certain problems. The tool means must have a tangential velocity which is substantially equal to the web velocity at the time of engaging the web. That is, the tool, i.e., that portion thereof which engages the web material, must move with the web at about the same speed as the web during engagement or else the tool will tear the web. Prior art attempts to deal with this problem usually involve accelerating and decelerating the tool means by means of clutches, eccentric gears or the like so that the tool means is slowed or speeded up as necessary at the time of engagement to match the web speed. The average tool means velocity must be maintained so that the tool completes its cycle and repeats the work operation at the desired repeat distance for a given constant average web velocity. Such acceleration and deceleration devices are cumbersome, complicated and expensive. The acceleration and deceleration forces impose strains on the equipment and require special mounting and shock absorbing means.

It is accordingly an object of the present invention to provide a novel and improved tool assembly in which the period of frequency of tool means engagement with the web, i.e., the repeat distance between tool work operations on the web, may be varied without necessity of speeding up or slowing down the tool means drive.

It is another object of the present invention to provide a tool assembly in which web velocity passing between the tool means is periodically increased and decreased and synchronized with the movement of the tool means while maintaining the through put web velocity constant in order to match tool means tangential velocity to the momentary web velocity at the time of engagement of the tool means with the web.

It is a further object of the present invention to provide a novel tool assembly in which stretching and/or buckling of the web means upstream or downstream of the tool assembly is precluded while web velocity through the tool means is reciprocatingly increased and decreased.

Yet another object of the present invention is to provide a novel tool assembly wherein a moving web of material is fed between a first and second opposed tool means defining a work station between them and guide members are employed to engage the moving web both before and after the work station with the guide means being simultaneously reciprocated to alternately increase and decrease the distance along the web path of travel from the guide member before the work station to the work station to alternately decrease and increase the momentary velocity of the web through the work station.

Other objects and advantages of the invention will become apparent from the following description.

SUMMARY OF THE INVENTION

The foregoing and related objects of the invention can be attained by a tool assembly which is operable to perform a work operation on a moving web of material. The tool assembly comprises a frame including a pair of spaced apart frame members, a web drive train to advance a web of material along a selected path of travel including a work station between the frame members, and first and second tool means. Mounting means mount the first and second tool means on the frame for periodic movement of the tool means at a selected frequency to and from a closely spaced work engaging position at a work station at which the tool means cooperate to perform a work operation on a web of material passing between them. The tool means have, at the time of performing the work operation, a tangential velocity in the direction of travel of the web along the path of travel. Shuttle means including first and second guide members are spaced along the path of travel and are adapted to engage the web, respectively, before and after the work performing station. Means are provided for mounting the shuttle means on the frame for simultaneous reciprocating movement of the guide members in at least first and second directions in the path of travel to respectively increase and decrease the velocity of the web through the work station by alternately shortening and lengthening that portion of the path of travel from the first guide member to the work station. Also included are drive means for effectuating, at a selected frequency, the periodic movement of the first and second tool means and the reciprocating movement of the shuttle means. Control means serve to synchronize the periodic movement of the tool means and the reciprocating movement of the shuttle means to provide a selected velocity of the web through the work station, which velocity is substantially equal to the tangential velocity of the tool means.

In accordance with certain aspects of the invention, the drive means includes a driven drive shaft, transmission gear means drivingly engaging the driven drive shaft with an eccentric drive shaft for imparting the reciprocating motion to the shuttle means, and tool gear means drivingly engaging the driven drive shaft with the mounting means for imparting the periodic movement to the tool means. Certain objects of the invention are attained when the eccentric drive shaft is connected by an eccentric assembly to the shuttle means, and when this connection is effectuated by adjustable engagement means which comprise the control means.

The adjustable engagement means, in accordance with a preferred embodiment of the invention, are adjustable and adapted thereby to engage the drive means to the shuttle means, more specifically, to engage the eccentric assembly to the shuttle means, in a selected phase relationship of the reciprocating movement of the shuttle means to the periodic movement of the tool means.

In accordance with another preferred embodiment, the mounting means comprise tool cranks mounted for rotation in the frame members and the tool means, which may comprise a pair of buckets, such as a die bucket and a punch bucket, have respective opposite ends thereof which are eccentrically supported on the tool cranks for imparting the periodic movement to the tool means by rotation of the tool cranks.

Certain objects of the invention are attained when the drive train includes a first web drive roll before the first guide member and a second web drive roll after the second guide member.

Other objects of the invention are attained by employing a method of performing a work operation on a moving web of material which comprises advancing a web of material along a selected path of travel including a work station as defined below. The web of material is engaged with a first guide member on the path of travel before entry of the web into the work station and with a second guide member on said path of travel after the work station. First and second tool members are periodically moved at a selected frequency to and from a closely spaced work engaging position (which defines the work station) and at which the tool means cooperate to perform a work operation on the web of material passing therebetween by periodically engaging the web at a tangential velocity of the tool means. The guide members are simultaneously reciprocatingly moved in at least first and second directions along the path of web travel to respectively increase and decrease the velocity of the web through the work station by alternately shortening and lengthening that portion of the path of travel from the first guide member to the work station.

The reciprocating movement of the guide members is synchronized with the periodic movement of the first and second tool means to provide a selected velocity of the web through the work station which is substantially equal to the tangential velocity of the tool means.

In certain aspects of the invention, the method further includes changing the repeat distance between work operations on the web by changing the frequency of the periodic movement of the tool means, whereby the tangential velocity of the tool means is correspondingly changed, and changing the velocity of said web through the work station at the time of engagement of the web by the tool means to equal the changed tangential velocity by changing the phase relationship of the reciprocating movement of the guide members to the periodic movement of the tool means.

Figure 1:
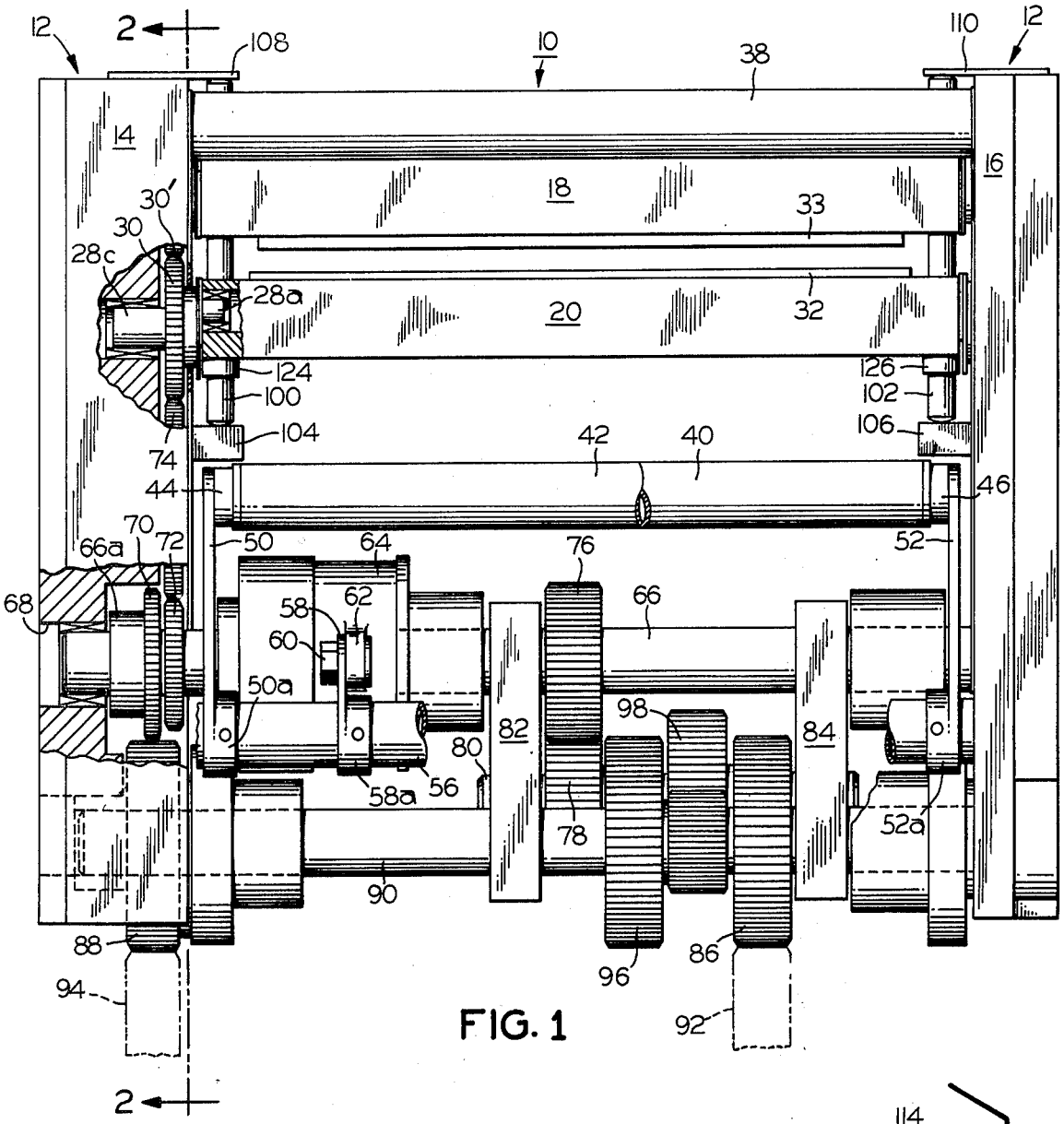
FIG. 1 is an end view in elevation, with parts broken away, of an embodiment of a tool assembly in accordance with the present invention.

Referring now to the drawings and more particularly FIG. 1 thereof, there is illustrated therein a tool assembly comprising a double bucket die cutting assembly, generally designated by reference number 10, constructed in accordance with the present invention. The double bucket die cutting assembly 10 includes a frame structure 12 which is comprised of a pair of elongated frame members 14 and 16. The members 14 and 16 function as a support means for the various elements which comprise the double bucket die cutting assembly 10 including the punch bucket 18 and the die bucket 20.

Figure 4:
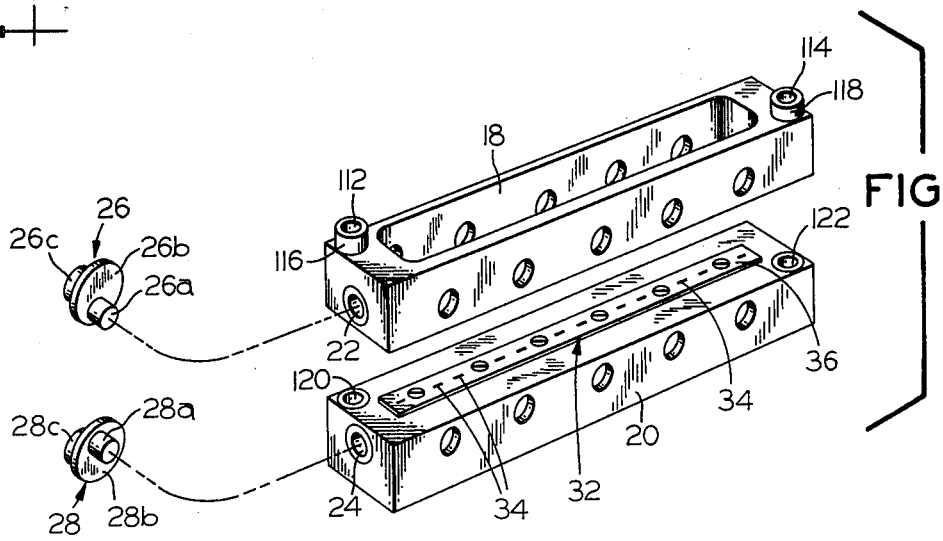
FIG. 4 is an exploded partial view showing some of the components of the embodiment of FIG. 1.

As best understood with reference to FIG. 4 of the drawings, each of the buckets 18 and 20 is generally rectangular in configuration and has a substantially hollow interior. Formed at each opposite end of buckets 18 and 20 are cylindrical shaped openings 22, 24, only one of which is visible in FIG. 4. Openings 22, 24 are suitably dimensioned to receive therein stub shafts *26a, 28a* of the tool cranks 26, 28. Only one each of the corresponding pair of tool cranks 26, 28 is shown in FIG. 4 for purposes of simplifying the drawings. It will be understood the corresponding tool crank is supplied at either end of, respectively, buckets 18 and 20. Tool cranks 26, 28 further include central shaft portions *26b, 28b* which are of enlarged diameter relative to the remainder of the tool cranks, and bearing shafts *26c, 28c* which extend from oppositely of stub shafts *26a, 28b*. As best seen in FIG. 1, tool crank 26, which is typical, is mounted for rotation in frame member 14, bearing shaft *26c* being supported therein on suitable bearing rollers. Tool crank 26 has affixed thereto adjacent to the shoulder defined by central shaft *26b* at the point where it merges into bearing shaft *26c*, a tool crank bearing 30. This arrangement is typical of all the tool cranks 26, 28. With the tool cranks thus mounted for rotation in frame members 14, 16 and having the buckets 18, 20 eccentrically mounted thereon the means are provided whereby buckets 18 and 20 are mounted on frame members 14 and 16 for periodic movement to and from a work engaging position as will be described more fully herein below. Referring further to FIG. 4 of the drawings, it will be noted therefrom that the cylindrical shaped openings 22, 24 are located off center relative to the axis of rotation of tool cranks 26, 28. Accordingly, the buckets 18 and 20 when mounted upon stub shafts *26a, 28a* are mounted eccentrically relative to tool cranks 26 and 28 whereby to provide a particular mode of operation for the assembly 10 to which further reference will be had subsequently. Although not shown in the drawings, it will be understood by those skilled in the art that punch bucket 18 is provided with a plurality of punches (not shown) which are suitably supported on a punch means 33 (FIG. 1) carried by bucket 18 across its major dimensions. Similarly, die bucket 20 is provided with die means 32 (FIG. 4) which cooperate with the punches of bucket 18 so as to perform the desired die punching operation on a web of material as the latter passes between the buckets 18, 20. Die means 32 may have any suitable form such as, for example, the form depicted in FIG. 4, i.e., a plurality of openings 34 which are formed in a plate 36 so as to be spaced therealong to cooperate with the punches. Plate 36 extends for most of the length of the major axis of die bucket 20 and is fastened thereto by any suitable fastening means.

As previously mentioned, tool cranks 26 and 28 are mounted in suitable openings (unnumbered, and only one shown in FIG. 1) with their respective stub shafts 26*a*, 28*a* supporting buckets 18, 20 so as to extend between and substantially at a right angle to frame members 14 and 16 as depicted in FIG. 1. The respective openings (only one shown) formed in frame members 14 and 16 are suitably vertically spaced from each other along frame members 14 and 16 so that buckets 18 and 20 are capable, as described more fully hereinafter, of moving in a vertical as well as horizontal direction as used with reference to FIG. 1. This movement is imparted by suitable gears connected to tool crank gear 30 which is suitably affixed to tool crank 26 as by a key member or the like. Each tool crank is provided in similar fashion with its associated tool crank gear.

Figure 3:
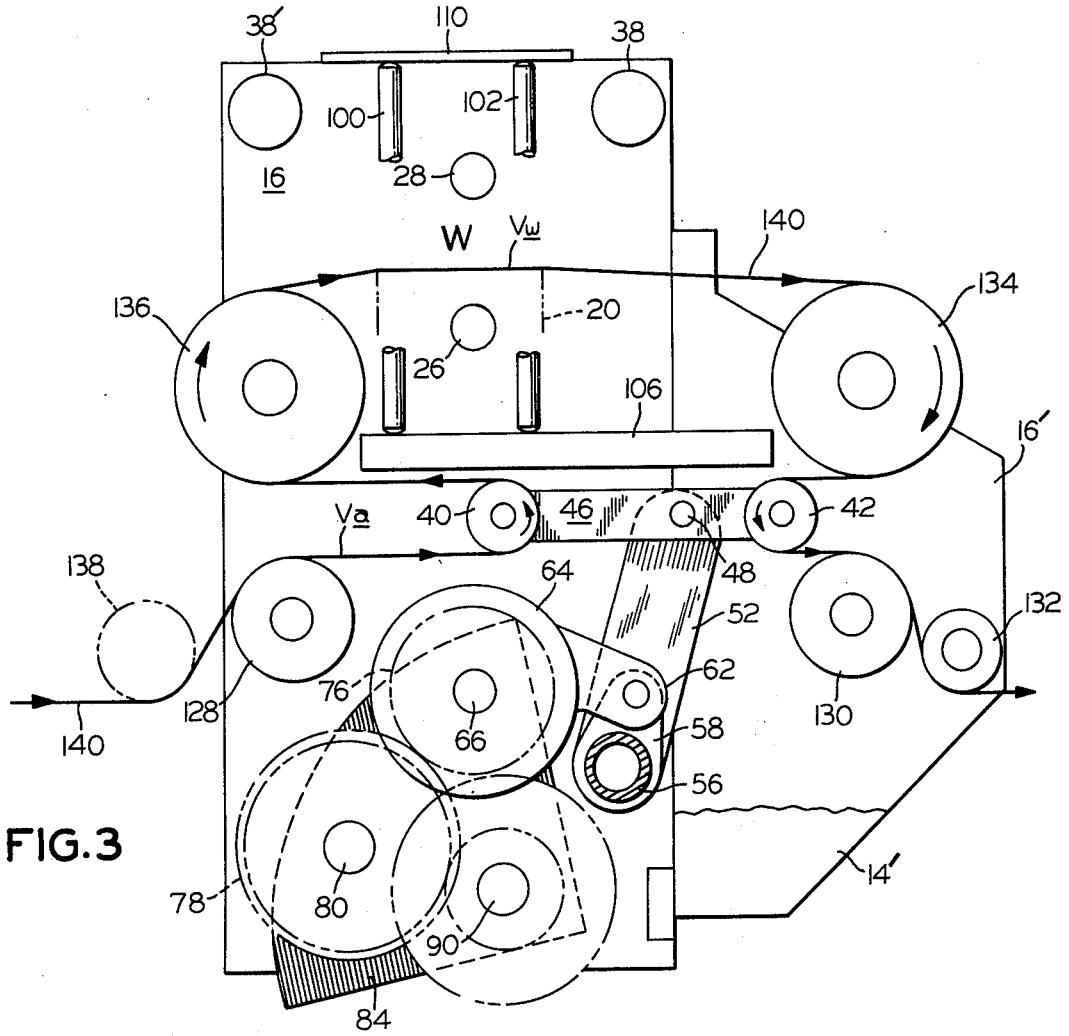
FIG. 3 is a somewhat schematic view of the embodiment of FIG. 1 generally corresponding to a section view taken along line 2—2 but in the opposite direction from section 2—2, i.e., rightwardly as viewed in FIG. 1.

Referring now jointly to FIGS. 1 and 3, supported on frame 12 below buckets 18, 20 are a pair of guide members provided by a pair of identical guide rollers 40, 42 which are disposed substantially parallel to each other and to the major longitudinal axis of buckets 18, 20. Guide rollers 40, 42 are mounted for rotation (as indicated by the arrows drawn thereon in FIG. 3) at their respective opposite ends in a pair of shuttle bars 44, 46, only one of which, 46, is shown in FIG. 3. Each of shuttle bars 44, 46 is connected by a pin connector 48 (FIG. 3) to a respective one of a pair of shuttle drive links 50, 52. The lowermost portions of shuttle drive links 50, 52 have formed thereon ring mounts 50*a*, 52*a* which encircle and are seated upon opposite ends of a tubular rocking bar 56, the opposite ends of which are journaled within suitable openings (not shown) provided in frame members 14, 16.

As shown in FIG. 1, threaded lock screws (unnumbered) are provided in ring mounts 50*a*, 52*a* to affix them securely to rocking bar 56.

A rocker link 58 has a similar ring mount 58*a* which is similarly affixed to rocking bar 56 and secured thereon by a threaded lock screw (unnumbered). Rocker link 58 has a circular hole formed adjacent to the end thereof remote from ring mount 58*a* adapted to receive therein the shaft of a locking bolt 60 therethrough. Locking bolt 60 serves to pin rocker link 58 to a rocker boss 62 which protrudes from an eccentric assembly 64. Rocker boss 62 has a circular opening in its distal end remote from eccentric assembly 64 sized to receive shaft of locking bolt 60 therethrough. Rocker link 58 and rocker boss 62 are pivotable with respect to each other about the shaft of bolt 60.

Assembly 64 is mounted upon an eccentric drive shaft 66 the opposite ends of which are journaled within openings 68 (only one shown in FIG. 1) in frame members 14, 16. As seen in FIG. 1, opening 68 is suitably provided with pin bearings to support its associated end of eccentric drive shaft 66 for rotation therein. Obviously, the opposite end of shaft 66 is similarly arranged although not shown in the drawing for the sake of simplicity.

Figure 3A:
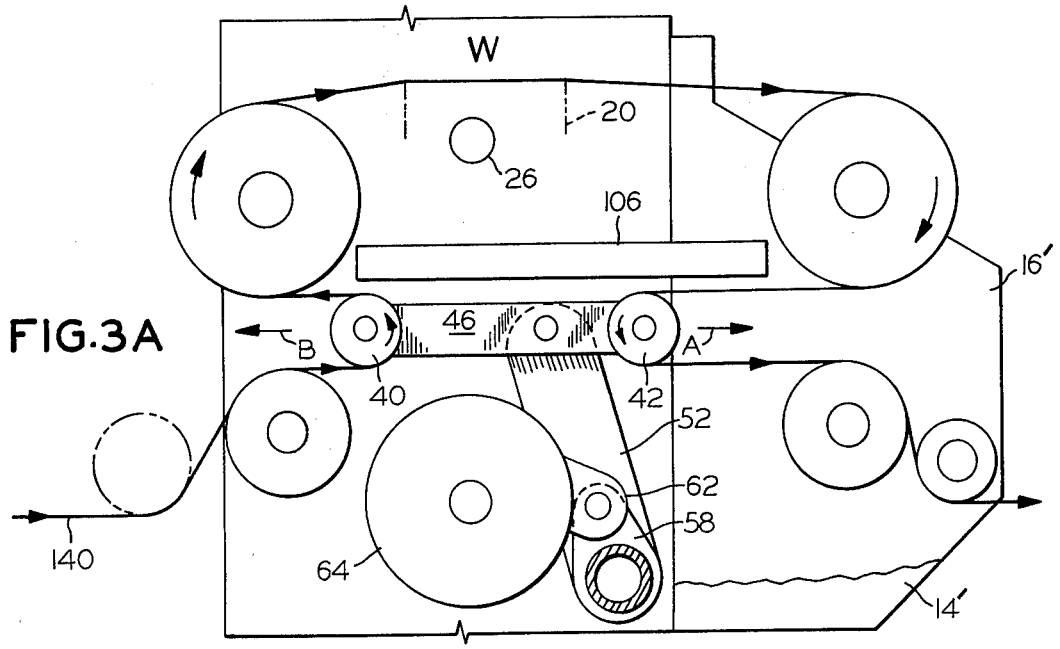
FIG. 3A is a partial view corresponding to that of FIG. 3 showing the apparatus in a different phase of its operation from that shown in FIG. 3.

Rotation of eccentric drive shaft 66 causes eccentric assembly 64 to periodically orbit therearound in a manner which causes rocker boss 62 to reciprocate back and forth between the extreme positions illustrated, respectively, in FIGS. 3 and 3A. As will be more fully explained herein below, such oscillation of rocker boss 62 correspondingly reciprocates rocker link 58 back and forth which in turn rocks rocking bar 56 back and forth within the openings in frames 14, 16 (not shown) in which the ends of rocking bar 56 are journaled. Obviously, the openings in frames 14, 16 in which the ends of rocking bar 56 are journaled may be provided with suitable roller bearings or the like for reducing friction. This rocking motion causes shuttle drive links 50, 52 to reciprocate back and forth thus carrying shuttle bars 44, 46 and guide rollers 40, 42 carried thereon back and forth between the extreme positions illustrated in FIGS. 3 and 3A, all for purposes to be described herein below.

Referring further to FIG. 1, adjacent the end of eccentric drive shaft 66 which is received within opening 68, an enlarged diameter portion 66*a* is formed and a drive gear 70 is affixed to shaft 66 adjacent thereto and abutting the shoulder provided by enlarged diameter portion 66*a*. Drive gear 70 is suitably affixed to gear 66 such as by being keyed thereto. Also keyed to shaft 66, adjacent drive gear 70 is a power take off gear 72 which is meshed in driving engagement with a transfer gear 74. In turn transfer gear 74 meshes with tool crank gear 30 which in turn meshes with tool crank gear 30', the latter being the tool gear associated with tool crank 26, not shown in FIG. 1.

A job gear 76 is also keyed to eccentric drive shaft 66 at approximately the mid point thereof and is drivingly meshed with a middle gear 78 which is carried on a short middle gear shaft 80 (FIG. 3) the extreme ends of which are visible in FIG. 1. Gear shaft 80 is journaled adjacent its ends for rotation in a pair of journal blocks 82, 84.

A pair of drive gears 86, 88 are keyed to main drive shaft 90 and are driven by a pair of driving gears 92, 94 partially shown in phantom outline in FIG. 1. Driving gears 92, 94 are powered from the main drive of a press or other machine on which tool assembly 10 is mounted, or may be driven by any suitable prime mover engine. A compound power take off gear 96 meshes with a corresponding compound pick off gear 98, partially obscured in FIG. 1.

Power to operate tool assembly 10 is derived from the press or other machine (not shown) which rotates driving gears 92 and 94 to rotate thereby main drive shaft 90. Power take off gear 96 by virtue of its meshed engagement with take off gear 98 rotates middle gear shaft 80 which in turn powers eccentric drive shaft 66 through the meshed engagement of middle gear 78 with job gear 76. The rotation of eccentric drive shaft 66 causes eccentric oscillation of eccentric assembly 64 which is mounted rotatably to eccentric drive shaft 66 for imparting the eccentric oscillatory motion to eccentric assembly 64. Power is also supplied to eccentric drive shaft 66 by the meshing of drive gear 88 with drive gear 70. Power take off gear 72 mounted on eccentric drive shaft 66 is meshed with transfer gear 74 which transfers power from shaft 66 to tool crank gear 30 to rotate it. Tool crank gear 30 is meshed with tool crank gear 30', to impart rotation thereto.

Still referring to FIG. 1, it will be appreciated that operation of punch bucket 18 and die bucket 20 require that they be maintained in proper alignment relative to each other as they are driven in periodic movement. To this end, a pair of vertically disposed alignment pins 100, 102 are carried adjacent the inside surfaces of, respectively, frame members 14 and 16 as will be now described. As best shown in FIG. 1, a pair of guide rails 104 and 106 are affixed, by any suitable fastening means to, respectively, the inside surfaces of frame members 14 and 16. A pair of guide brackets 108 and 110 are similarly affixed to the tops of, respectively, frame members 14 and 16 in a manner such that one end of each of guide brackets 108 and 110 projects inwardly of, respectively, frame members 14 and 16 the distance corresponding to the depth to which rails 104 and 106 project inwardly from frame members 14 and 16. Rail 104 and bracket 108 thus define between them what is in effect a guide track. Rail 106 and bracket 110 are similarly disposed with respect to each other.

Referring now to FIG. 4, bucket 18 is seen to have a pair of vertically extending circular openings 112, 114. These openings extend throughout the entire depth of bucket 18 and in fact project above it a short distance by virtue of sleeves 116 and 118. Similarly, bucket 20 has a pair of vertically extending circular openings 120, 122 which extend throughout the depth of bucket 20 and in fact are extended below the lower most surface thereof by sleeves 124 and 126, not visible in FIG. 4 but shown in FIG. 1. It will be noted that circular openings 112, 114 are disposed at opposite ends of bucket 18 in diagonally opposite corners thereof. Circular openings 120, 122 are similarly disposed in bucket 20 so that with bucket 18 disposed vertically above bucket 20 circular openings 112 and 120 are in vertical alignment and circular openings 114 and 122 are in vertical alignment. Pins 110, 102 are round in cross section and their diameters are dimensioned such that the associated circular openings 112, 120 and 114, 122 fit slidably over, respectively, pins 100 and 102. The length of pins 100 and 102 is such that when the pins are vertically disposed as shown in FIGS. 1 and 3, pin 100 slidably contacts bracket 108 and rail 104 and pin 102 similarly slidably contacts 110 and rail 106. In this regard, see also FIG. 3 from which brackets 108 and rail 104 have been deleted for clarity of illustration. Thus, when pins 100, 102 are positioned in, respectively, circular openings 112, 120 and 114, 122 in buckets 18 and 20, and buckets 18 and 20 are supported between frame members 14 and 16 as shown in FIG. 1, the end tips of the pins are guided between their associated brackets and rails and travel horizontally with their associated buckets to maintain them in vertical alignment during operation.

Referring now to FIG. 3, there is schematically illustrated a first web drive roll 128 and a second web drive roll 130. First web drive roll is mounted on frame members 14, 16 and second web drive roll 130 is mounted on frame extension 16', shown schematically in FIG. 3. Frame extension 16' and the rollers mounted thereon are not shown in FIG. 1. It will be appreciated that frame extension 16' comprises a generally flat plate structure shaped in plan outline as shown in FIG. 3 of approximately the same thickness as frame members 16 and extending forwardly therefrom. It will further be appreciated that frame extension 14', broken away in FIGS. 3 and 3A for clarity of illustration, is similar to frame extension 16'. Second web drive roll 130 is thus joined for rotation at its opposite ends in frame extensions 14', 16'. An outlet roller 132 is similarly journaled between frame extensions 14' and 16'. Also journaled at its opposite ends between frame extensions 14' and 16' is an outlet web roller 134. An inlet web roller 136 is journaled for rotation between frame members 14 and 16. Support bars 38, 38' are employed to support frame members 14, 16 in their proper spaced apart alignment. An inlet roller 138 is shown in dotted outline in FIG. 3 and is suitably journaled at its opposite ends in an appropriate support, not shown.

A web of material 140 is fed by means of first and second web drive rolls which are suitably powered to advance web 140 through the tool assembly in the direction indicated by the arrow heads drawn on web 140. It will be appreciated, that web 140 may have a width up to the width provided by the length of the major axis of buckets 18 and 20. Web 140 may be any suitable material such as paper, cloth, plastic sheet, or composite materials upon which it is desired to carry out a work operation such as die punching. Web 140 is engaged by guide roller 40 and passes there around and back over inlet web roller 136 thence between buckets 18 and 20 (not shown in FIG. 3). and around outlet web roller 134 and over it to be engaged by guide roller 42. Web 140 passes over guider roller 42 and then over second web drive roll 130 and outlet roller 132 to storage or to a subsequent processing step.

Figure 5:
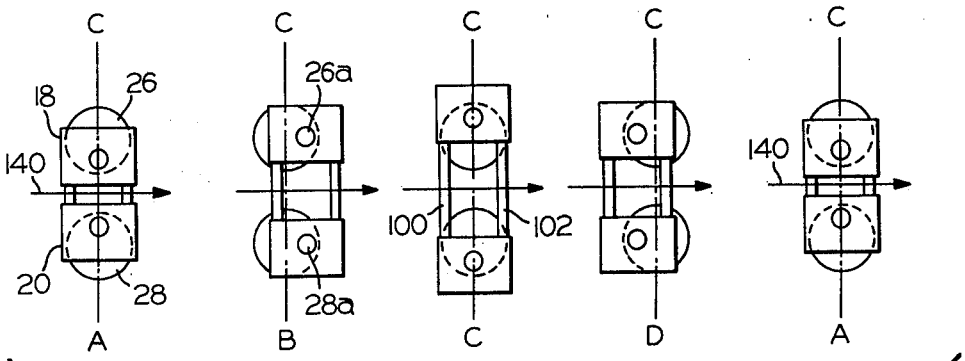
FIG. 5 is a schematic side view of the components of FIG. 4 showing a sequence of their operation.

In operation, the continuous web 140 of stock material is continually fed through die cutting assembly 10 as buckets 18 and 20 are operated by rotation of a drive shaft 90 between a spaced apart position as shown in FIG. 1 and a closely spaced position (not shown) in which punch may penetrate web 140 to openings 34 of bucket 20 to perform a die punching operation on the moving web. As rotation continues buckets 18 and 20 come apart with stock web 140 continuing to advance and then proceed to come together again to repeat the work operation on the advancing web. The sequence is schematically illustrated in FIG. 5 in which web 140 shown advancing in the direction indicated by the arrow between buckets 18 and 20 which in part A of FIG. 5 are shown closely spaced to each other at the moment of engaging the web to perform the work operation thereon. The center line C passes vertically through the respective axes of rotation of tool cranks 26 and 28. At he moment of contacting web 140, the tool means, provided in this case by buckets 18 and 20, have a tangential velocity, that is, the velocity of the punches at the point at which web 140 is tangent to the arc of rotation described by the tool means, i.e., buckets 18 and 20. Buckets 18 and 20 are describing the orbiting movement indicated by the circular arrows in part A of FIG. 5 and thus at the moment of contact with web 140 have a velocity vector which is moving parallel to the movement of web 140 and this vector is referred to as the tangential velocity of the tool means. Part B of FIG. 5 shows a later portion of the cycle with the tool means having disengaged web 140 and buckets 18, 20 having rotated upwardly and towards the right as indicated by their position relative to the center line C. Step C of the sequence shows buckets 18 and 20 at their maximum distance from each other and ready to commence their downward stroke as shown in step D. To the extreme right of FIG. 5, step A is shown repeated wherein the tool means are engaging web 140 and repeating the work operation thereon.

It will be appreciated by those skilled in the art that the tangential velocity of the tool means must be substantially equal to the velocity of web 140 passing between the tool means which may be considered to define between them a work station at which the work operation, i.e., die punching in the illustrated case, is performed. The average throughout velocity of web 140 through assembly 10 usually must remain fixed at a constant velocity. For example, assume that the velocity of web 140 is 100 linear inches per second. Normally this velocity will have to be held since it is not feasible to speed up or slow down the web speed travel and in any event the maximum velocity obtainable from the web drive equipment and which can be handled by the tool assembly is usually desired in order to maximize production. If it is desired to change the repeat distance between work operations on web 140 it is therefore necessary to change the frequency of periodic movement of the tool means represented in this case by buckets 18 and 20. This may be done by simply changing, in the known manner, the rpm at which tool crank gears 30 and 30' are driven. This may be effectuated by a suitable motor control or by selecting the appropriate size gears. The tangential velocity of the tool means must also be 100 inches per second or sufficiently close thereto to prevent tearing of the web material by having it move at a different speed relative to the portion (e.g., the punches) of the tool means which is engaging the web. Assume that buckets 18 and 20 are rotating at 300 rpm and have a tangential velocity of 100 inches per second. The repeat distance between work operations on web 140 will thus be 20 inches. If it is desired to change the repeat distance to, say, 10 inches, it is necessary to operate buckets 18 and 20 at 600 rpm. However, this will substantially increase the tangential velocity of the tool means while engaging the web. It is therefore necessary, to increase the web velocity within the work station between the buckets 18 and 20 and this is effectuated in the following described manner. Rotation of drive shaft 90 also rotates, as described above, eccentric drive shaft 66 which, as also described above, causes shuttle drive link 52 to reciprocate between the extreme positions illustrated in FIGS. 3 and 3A. This reciprocates the shuttle means, which may be considered as being comprised by the assembly of shuttle drive links 50, 52, shuttle bars 44 and 46 and guide rollers 40 and 42, back and forth in first and second directions as indicated by the arrows A and B in FIG. 3A. As the shuttle means is moving rightwardly as viewed in FIGS. 3 and 3A, i.e., in the direction indicated by arrow A, the path of travel along web 140 between guide roller 40 and the work station indicated by the letter W in FIGS. 3 and 3A is increased. Thus the velocity with which shuttle means is moving rightwardly as viewed in FIGS. 3 and 3A is effectively substracted from the average web velocity Va existing before first guide means 40. Velocity Vw existing at work station W is thus equal to the algebraic difference between velocity Va and the velocity with which the shuttle means is moving rightwardly as viewed in FIGS. 3 and 3A. Similarly, when the shuttle means is reciprocating in the second direction, leftwardly as viewed in FIGS. 3 and 3A in the direction indicated by arrow B in FIG. 3A, the distance along the web path of travel between first guide roller 40 and work station W is being shortened so that the web velocity Vw existing in work station W is equal to the algebraic sum of the average web velocity Va and the velocity at which the shuttle is moving leftwardly. Since the shuttle means is reciprocating and reversing direction, at the moment it reverses direction, which occurs at each of the two extreme positions illustrated in FIGS. 3 and 3A, the shuttle means horizontal velocity is 0 and at that moment the web velocity Vw equals the average web velocity Va. It will thus be appreciated that the velocity Vw of web 140 in work station W might be graphically plotted as a sine curve, Vw peaking at a maximum value when the shuttle means attains its maximum velocity at about the mid point of its travel from the position shown in FIG. 3 to the position shown in FIG. 3A, Vw drops down to equal the average velocity Va when the shuttle means is in its position shown in FIG. 3A. As the shuttle means reverses direction and moves rightwardly in the direction of arrow A when it attains the mid point of its movement towards the position shown in FIG. 3 web velocity Vw has dropped to its minimum and as it continues to move rightwardly as viewed in FIG. 3 its speed of travel slows and velocity Vw increases back towards the value of Va which it attained when the shuttle means reaches its rightward position shown in FIG. 3. Thus as the shuttle means reciprocates back and forth in the first and second directions, effective web velocity Vw within work station W periodically passes from a maximum value greater than the average velocity Va to a mimimum value less than the average velocity Va.

It will be apparent, that the magnitude of the increase and decrease in velocity Vw depends upon the velocity of travel of the shuttle means and the distance of such travel. This in turn is dependent upon the degree of eccentricity of eccentric assembly 64 and the speed of rotation of eccentric drive shaft 66. The degree of eccentricity may be varied by suitably replacing eccentric assembly 64 with a differently dimensioned eccentric assembly of similar construction by employing different size and proportion shuttle drive links 50, 52.

It is necessary to insure that the phase relationship of the reciprocating shuttle means of travel is properly synchronized with the periodic movement of the buckets 18, 20. Thus, if the buckets have been speeded up relative to their original setting, the shuttle means must be in a phase which increases the velocity Vw at the time of engagement of the tool means with the web 140. If the buckets 18 and 20 have had their rpm speed decreased relative to the original setting whereby their tangential velocity is correspondingly decreased the phase relationship of the shuttle means to the buckets 18, 20 must be changed so that at the time of engagement of the tool means with web 140 the web velocity Vw has been appropriately decreased to match the decreased tangential velocity. Such adjustment of the phase relationship of the shuttle means with the tool means comprised by buckets 18 and 20 is attained simply by loosening the threaded lock screw which secures mounting ring 58*a* to rocking bar 56. This permits the shuttle means to be moved by hand to the proper phase relationship and mounting ring 58*a* is then locked in place. It will be apparent to those skilled in the art that indicia means, not shown, may be provided to facilitate adjusting the proper phase relationship between the shuttle means and the buckets 18 and 20. Further it will be appreciated that for a given gear arrangement and an eccentric assembly and shuttle means of given dimensions, precise synchronization and selection of web velocity adjustment may be provided. The movement of the shuttle and guide members gaging the webs to reciprocatingly and alternately increase and decrease the distance of web path travel between first guide roller 40 and work station W to thereby correspondingly increase and decrease web velocity Vw in the work station W has a tendency to stretch the web 140 both before and after, i.e., upstream and downstream, of the tool assembly 10. This tends to cause registration problems at press stations upstream and downstream of the assembly 10. To overcome this, web drive rolls 128 and 130 are provided before and after assembly 10 to isolate the web from the upstream and downstream stations.

The structure of the invention thus enables selected changes in the repeat distance by adjusting the eccentric and changing the transmission gearing and job gear and adjusting the phase relationship of the shuttle means without necessity of acceleration or deceleration brakes, clutches, changes in the buckets, etc as is required with the prior art devices.

Figure 2:
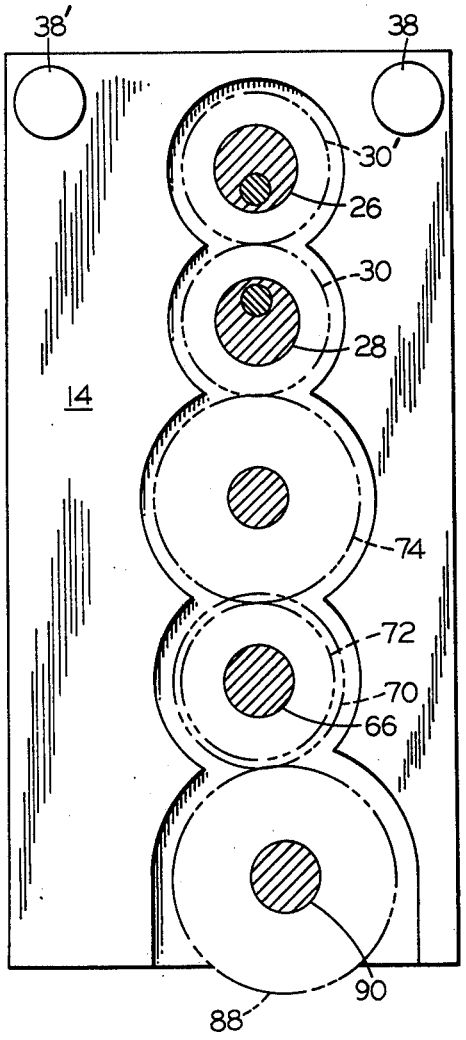
FIG. 2 is a section view taken along line 2—2 of FIG. 1.

FIG. 2 illustrates the relationship of the various members and indicates the compact construction provided by the structure of the invention.

While the invention has been described with respect to a specific embodiment thereof, it will be appreciated that numerous modifications and alterations thereto may be made without the departing from the spirit and scope of the invention. For example, instead of the punch and die buckets illustrated, a pair of opposed rollers could be provided, one of which contains longitudinally extending raised portion of greater diameter than the roller diameter so that passage of the web between two such opposed rollers would periodically nip and release the web to perform a printing or embossing operation thereon. Changes in rotational speed would change the tangential velocity of the raised portions as they periodically nip the traveling web between them and web velocity would be adjusted by the shuttle means of the invention similar to the manner described above. It is intended to include all such variations within the scope of the appended claims.

Having thus described the invention, what is claimed is:

1. A tool assembly operable to perform a work operation on a moving web of material comprising:

(a) a frame including a pair of spaced apart frame members;

(b) a web drive train to advance a web of material along a selected path of travel including a work station between said frame members;

(c) first and second tool means;

(d) mounting means mounting said first and second tool means on said frame for periodic movement of said tool means at a selected frequency to and from a closely spaced work engaging position at a work station at which said tool means cooperate to perform a work operation on a web of material passing therebetween, said tool means having, at the time of performing said work operation, a tangential velocity in the direction of travel of said web along said path of travel;

(e) shuttle means including a pair of spaced apart shuttle bars disposed along said path of travel of the web, and first and second guide members extending transversely between said shuttle bars adjacent their opposite ends, said first and second guide members being adapted to engage the web, respectively, before and after said work station;

(f) means mounting said shuttle means on said frame for simultaneous reciprocating movement of said shuttle bars and guide members in at least first and second directions in said path of travel to respectively increase and decrease the velocity of the web through said work station by alternately shortening and lengthening that portion of said path of travel from said first guide member to said work station;

(g) drive means for effectuating, at a selected frequency, said periodic movement of said first and second tool means and said reciprocating movement of said shuttle means, said drive means including an eccentric assembly drivingly connected to said shuttle bars to effect reciprocating movement thereof; and (h) control means to synchronize the periodic movement of said tool means and the reciprocating movement of said shuttle means to provide a selected velocity of the web through said work station which is substantially equal to the tangential velocity of said tool means, said control means including adjustable engagement means connectable to said shuttle means to synchronize a selected phase of said reciprocating movement of said shuttle means with said periodic movement of said tool means, said drive means and said drive train operating simultaneously so that the web is continuously advanced along said path of travel, said tool means acting upon the web as it continues to move through the work station.

2. The assembly of claim 1 wherein said mounting means for mounting said first and second tool means comprises tool cranks mounted for rotation in said respective frame members with said tool means having opposite ends thereof eccentrically supported thereon for imparting said periodic movement to said tool means by rotation of said tool cranks, and said drive means includes a driven drive shaft engaged by tool gear means with said tool cranks for rotation of the latter.

3. The assembly of claim 2 wherein said first tool means comprises a punch bucket, said second tool means comprises a die bucket and the work operation comprises a die punching operation.

4. The assembly of claim 1 wherein said drive means includes a driven drive shaft, an eccentric drive shaft engaged with said driven drive shaft by transmission gear means and an eccentric assembly driven by said eccentric drive shaft and connected to said shuttle means to impart said reciprocating motion to said shuttle means.

5. The assembly of claim 1 wherein said web drive train includes a first web drive roll before said first guide means and a second web drive roll after said second guide means.

6. A tool assembly operable to perform a work operation on a moving web of material comprising:

(a) a frame including a pair of spaced apart frame members;

(b) a web drive train to advance a web of material along a selected path of travel including a work station between said frame members;

(c) first and second tool means;

(d) mounting means mounting said first and second tool means on said frame for periodic movement of said tool means at a selected frequency to and from a closely spaced work engaging position at a work station at which said tool means cooperate to perform a work operation on a web of material passing therebetween, said tool means having, at the time of performing said work operation, a tangential velocity in the direction of travel of said web along said path of travel;

(e) shuttle means comprising a pair of spaced apart shuttle bars, first and second guide members extending between said shuttle bars with respective opposite ends of said guide members supported on said shuttle bars adjacent respective opposite ends of said shuttle bars, a pair of shuttle drive links respectively connected adjacent their one ends to said shuttle bars, and a rocker shaft connected to respective ones of said shuttle drive links adjacent their other ends, said first and second guide members being spaced along said path of travel and adapted to engage the web, respectively, before and after said work station, said shuttle means being mounted on said frame for simultaneous reciprocating movement of said guide members in at least first and second directions in said path of travel to respectively increase and decrease the velocity of the web through said work station by alternately shortening and lengthening that portion of said path of travel from said first guide member to said work station;

(f) drive means including a driven drive shaft, an eccentric drive shaft engaged with said driven drive shaft by transmission gear means, tool gear means engaged with said driven drive shaft to drive said mounting means, and an eccentric assembly driven by said eccentric drive shaft and connected as defined herein below to said shuttle means to impart said reciprocating motion thereto for effectuating, at a selected frequency, said periodic movement of said first and second tool means and said reciprocating movement of said shuttle means; and (g) control means comprising adjustable engagement means connecting said eccentric assembly to said shuttle means as defined above to engage said drive means to said shuttle means in a selected phase relationship of the said reciprocating movement of said shuttle means to said periodic movement of said tool means whereby to synchronize the periodic movement of said tool means and the reciprocating movement of said shuttle means to provide a selected velocity of the web through said work station which is substantially equal to the tangential velocity of said tool means.

7. The assembly of claim 6 wherein said mounting means comprise tool cranks respectively mounted for rotation in said frame members and in driven engagement with said tool gear means, and said first and second tool means comprise tool buckets having opposite end portions eccentrically supported on said tool cranks whereby rotation of said tool cranks imparts said periodic movement to said first and second tool means.

8. A tool assembly operable to perform a work operation on a moving web of material comprising:

(a) a frame including a pair of spaced apart frame members;

(b) a web drive train to advance a web of material along a selected path of travel including a work station between said frame members;

(c) first and second tool means;

(d) mounting means mounting said first and second tool means on said frame for periodic movement of said tool means at a selected frequency to and from a closely spaced work engaging position at a work station at which said tool means cooperate to perform a work operation on a web of material passing therebetween, said tool means having, at the time of performing said work operation, a tangential velocity in the direction of travel of said web along said path of travel;

(e) shuttle means including a pair of spaced apart shuttle bars, a pair of guide members extending between said shuttle bars with respective opposite ends of said guide members supported adjacent respective opposite ends of said shuttle bars, a pair of shuttle drive links respectively connected adjacent their one ends to said shuttle bars, and a rocker shaft connected to respective ones of said shuttle drive links adjacent their other ends, said first and second guide members being spaced along said path of travel and adapted to engage the web, respectively, before and after said work performing station;

(f) means mounting said shuttle means on said frame for simultaneous reciprocating movement of said guide members in at least first and second directions in said path of travel to respectively increase and decrease the velocity of the web through said work station by alternately shortening and lengthening that portion of said path of travel from said first guide member to said work station;

(g) drive means for effectuating, at a selected frequency, said periodic movement of said first and second tool means and said reciprocating movement of said shuttle means; and (h) control means to synchronize the periodic movement of said tool means and the reciprocating movement of said shuttle means to provide a selected velocity of the web through said work station which is substantially equal to the tangential velocity of said tool means.

9. The assembly of claim 8 wherein said guide members are guide rollers and said rocker shaft extends substantially parallel to said guide rollers and is connected at its opposite ends to said shuttle drive links.

10. The assembly of claim 9 wherein said drive means includes an eccentric assembly connected to said rocker shaft to impart said reciprocating motion to said shuttle means.

11. A tool assembly operable to perform a work operation on a moving web of material comprising:

(a) a frame including a pair of spaced apart frame members;

(b) a web drive train to advance a web of material along a selected path of travel including a work station between said frame members;

(c) first and second tool means;

(d) mounting means mounting said first and second tool means on said frame for periodic movement of said tool means at a selected frequency to and from a closely spaced work engaging position at a work station at which said tool means cooperate to perform a work operation on a web of material passing therebetween, said tool means having at the time of performing said work operation, a tangential velocity in the direction of travel of said web along said path of travel;

(e) shuttle means including first and second guide members spaced along said path of travel and adapted to engage the web, respectively, before and after said work performing station;

(f) means mounting said shuttle means on said frame for simultaneous reciprocating movement of said guide members in at least first and second directions in said path of travel to respectively increase and decrease the velocity of the web through said work station by alternately shortening and lengthening that portion of said path of travel from said first guide member to said work station;

(g) drive means for effectuating, at a selected frequency, said periodic movement of said first and second tool means and said reciprocating movement of said shuttle means, said drive means including a driven drive shaft, an eccentric drive shaft engaged with said driven drive shaft by transmission gear means, tool gear means engaged with said driven drive shaft to drive said mounting means, and an eccentric assembly driven by said eccentric drive shaft and connected by said adjustable engagement means to said shuttle means to impart said reciprocating motion thereto; and (h) control means to synchronize the periodic movement of said tool means and the reciprocating movement of said shuttle means to provide a selected velocity of the web through said work station which is substantially equal to the tangential velocity of said tool means, said control means comprising adjustable engagement means adapted to engage said drive means to said shuttle means in a selected phase relationship of said reciprocating movement of said shuttle means to said periodic movement of said tool means.

12. A tool assembly operable to perform a work operation on a moving web of material comprising:

(a) a frame including a pair of spaced apart frame members;

(b) a web drive train to advance a web of material along a selected path of travel including a work station between said frame members;

(c) first and second tool means;

(d) mounting means mounting said first and second tool means on said frame for periodic movement of said tool means at a selected frequency to and from a closely spaced work engaging position at a work station at which said tool means cooperate to perform a work operation on a web of material passing therebetween, said tool means having at the time of performing said work operation, a tangential velocity in the direction of travel of said web along said path of travel;

(e) shuttle means including first and second guide members spaced along said path of travel and adapted to engage the web, respectively, before and after said work performing station;

(f) means mounting said shuttle means on said frame for simultaneous reciprocating movement of said guide members in at least first and second directions in said path of travel to respectively increase and decrease the velocity of the web through said work station by alternately shortening and lengthening that portion of said path of travel from said first guide member to said work station;

(g) drive means for effectuating, at a selected frequency, said periodic movement of said first and second tool means and said reciprocating movement of said shuttle means, said drive means including a driven drive shaft, transmission gear means drivingly engaging said driven drive shaft to an eccentric drive shaft for imparting said reciprocating motion to said shuttle means, and tool gear means drivingly engaging said driven drive shaft with said mounting means for imparting said periodic movement to said tool means; and (h) control means to synchronize the periodic movement of said tool means and the reciprocating movement of said shuttle means to provide a selected velocity of the web through said work station which is substantially equal to the tangential velocity of said tool means, said eccentric drive shaft being connected to an eccentric assembly, said control means including adjustable engagement means connecting said eccentric assembly to said shuttle means to impart said reciprocating movement to said shuttle means, said adjustable engagement means being selectively connectable to said shuttle means to synchronize a selected phase of said reciprocating movement of said shuttle means with said periodic movement of said tool means.

* * * * *